United States Patent [19]

Lindsay

[11] 4,292,911

[45] Oct. 6, 1981

[54] ROLLER CHOCK

[76] Inventor: John Lindsay, 16 Harbor St., Manchester, Mass. 01944

[21] Appl. No.: 146,914

[22] Filed: May 5, 1980

Related U.S. Application Data

[63] Continuation of Ser. No. 879,726, Feb. 21, 1978, abandoned.

[51] Int. Cl.[3] ..... B63B 21/08

[52] U.S. Cl. ..... 114/218

[58] Field of Search ..... 114/109, 218, 230, 101; 24/115 R, 115 CH, 115 J, 132

[56] References Cited

U.S. PATENT DOCUMENTS 24,810 7/1859 Knowlton ..... 114/218

316,997 5/1885 Murch ..... 114/218

2,691,814 10/1954 Tait ..... 308/DIG. 7

*Primary Examiner*—Trygve M. Blix

*Assistant Examiner*—Jesus D. Sotelo

*Attorney, Agent, or Firm*—Cesari and McKenna

[57] ABSTRACT

A roller chock for a boat. The chock includes an elongated base plate that mounts at the edge of a hull. A curved arm extends upwardly and aft to provide a smooth rubbing surface that is aligned with the general direction of a rode or other line. Spaced from the arm is a roller assembly having a top plate with portions extending forward and toward the center of the boat. A roller rotates with the line if it bends around the roller thereby to minimize wear on the line. The plate and the curved arm capture the line.

1 Claim, 5 Drawing Figures

FIG. 1
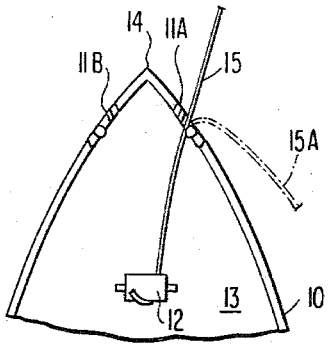
FIG. 2
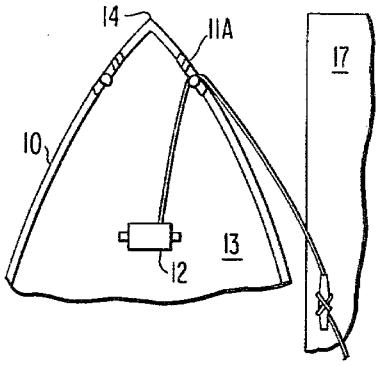
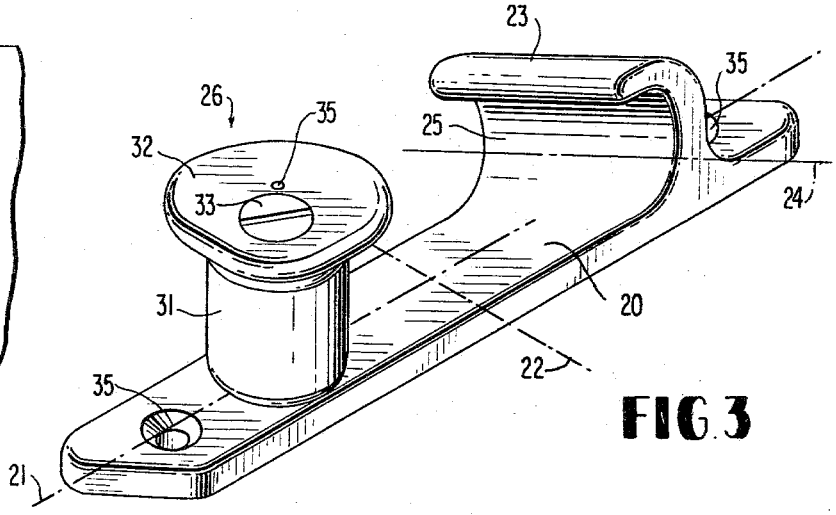
FIG. 3
FIG. 4
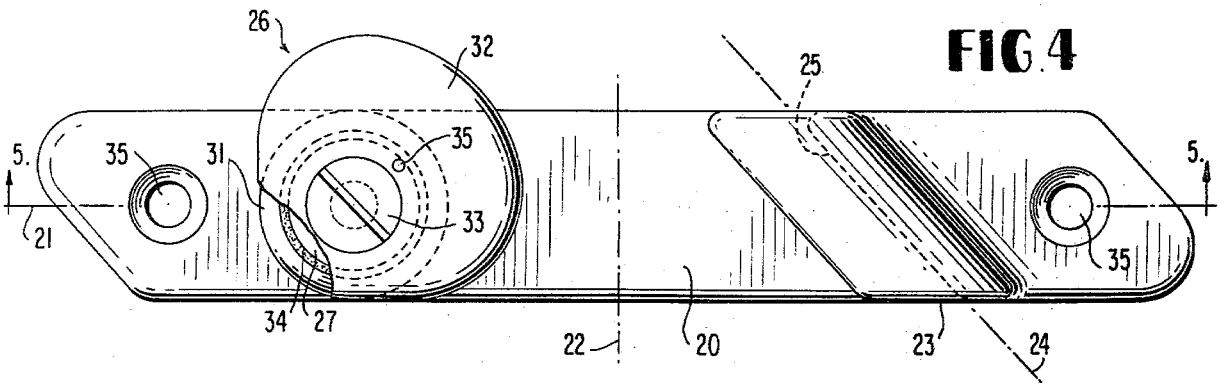
FIG. 5
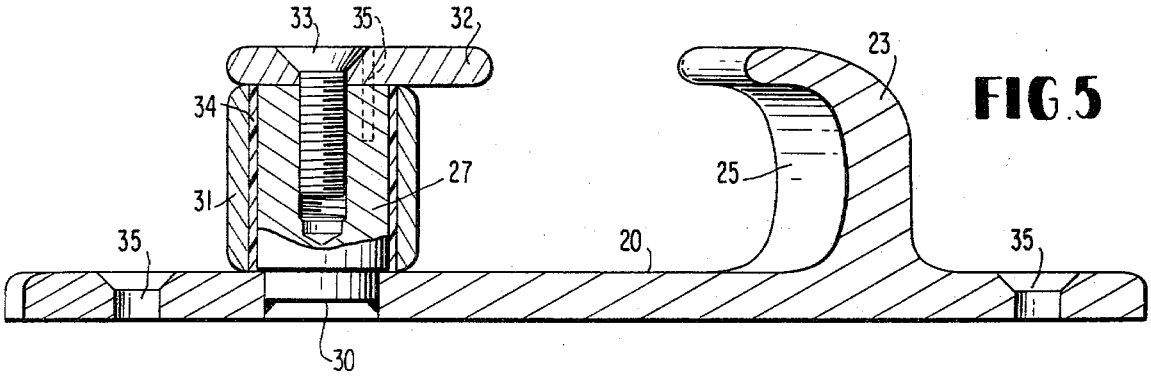

ROLLER CHOCK

This is a continuation of application Ser. No. 879,726 filed Feb. 21, 1978 now abandoned.

BACKGROUND OF THE INVENTION

This invention generally relates to marine hardware and more specifically to chocks for use on boats.

A wide variety of chock structures have been proposed. Conventionally, bow and stern chocks, for example, include two upwardly extending arms that curve toward each other thereby to define a large partially closed area. Access is through a restricted opening between the curved arms. The arms also may be skewed with respect to a base plate in order to align with the general direction of a line extending from a bitt or cleat on a deck through the chock and then to an anchor, mooring or dock cleat or bitt.

For example, when a boat is at anchor, a rode extends from a main cleat on a deck forward through a bow chock and then to an anchor or mooring. So long as a boat lies so this rode orientation is maintained, minimal wear occurs because the inner surface of the forward curved arm essentially parallels the direction of the rode. However, many times wind, tide and current conditions cause the boat to ride forward on the mooring or anchor so that the rode leads aft from the bow chock. At a dock a bow line is lead aft as a spring line. In these situations, the rode bends sharply about the narrow edge of the aft curved arm. As boats are constantly undergoing motion while at anchor or tied at a dock, the edge of the aft arm wears and chafes, and thereby weakens, the rode. As a result, it is necessary to replace rodes periodically.

Other chock structures have been proposed. In one, known as a warping chuck, spaced rollers are captured between upwardly extending spaced arms and a base plate. If such a warping chock were adapted for use as a bow chock, the rode would then ride on either roller depending upon its orientation.

In another approach a horizontal base element is affixed to a deck and a horizontal curved arm is spaced from the base element. This base element and carved arm capture a roller between them that rotates on a vertical axis so the rode rides on the roller. The curved arm extends over the rode thereby to capture it.

It would appear that either of these proposed structures should solve the chafing problem. Indeed warping chucks are used on large craft. However, for pleasure craft, the conventional curved arm bow chock having two fixed, inwardly curved arms continues to be the accepted bow chock. Apparently, this acceptance stems from the overall reliability and low cost of the curved arm bow chocks. From the standpoint of reliability bow chocks are not subject to malfunctions due to corrosion as they include no moving parts. They also are integral, cast structures so they are very inexpensive to manufacture. Thus, generally, a pleasure boat owner uses the conventional bow chock and adds chafing guard to protect the line.

A chafing guard essentially comprises a section of inexpensive rubber or plastic hose or tubing that is fitted over and affixed to the rode where it passes through a chock. Any chafing then wears the chafing guard, not the rode. The guard only needs be replaced when it wears out. Obviously, the cost of replacing such a chafing guard is significantly less than the cost for replacing an entire rode.

However, chafing gear sometimes is cumbersome to handle. It must be repositioned on a line at a chock each time the line is led through a chock. In addition the chafing gear increases the effective size of the line and makes it difficult to stow the line. For example, oftentimes a line is led through a standpipe through the deck that is sized for a specific rode diameter. The chafing guard normally will not pass through such a standpipe. Thus, it is necessary either to leave a portion of the rode on the deck and thereby clutter the deck, or to remove the chafing guard and stow it separately.

It is an object of this invention to provide an improved chock that reduces the wear on the lines of a boat.

Another object of this invention is to provide an improved chock that provides an extended life in a marine environment.

Still another object of this invention is to provide a chock that requires minimal maintenance.

Yet still another object of this invention is to provide a chock that is relatively inexpensive to produce and simple to construct.

SUMMARY

In accordance with this invention my chock uses a single roller assembly to reduce line chafe. This assembly is mounted onto one side of the center of an elongated base. A upwardly extending arm offset from the roller assembly on the other side of the center of the base curves toward the center and aligns with a normal line orientation. Whenever the line is lead around the roller assembly, any line motion causes the roller to rotate thereby eliminating any sliding friction which otherwise would chafe the rode. A flange having portions extending toward the center of the boat and toward the curved arm coacts with the curved arm to capture the rode between the curved arm and the roller assembly.

This invention is pointed out with particularity in the appended claims. The above and further objects and advantages of this invention may be better understood by referring to the following detailed description taken in conjunction with the accompanying drawings.

BRIEF DESCRIPTION OF THE DRAWINGS

FIG. 1 is a top view of the bow section of a boat to show the normal orientation of a rode passing through a roller chock constructed in accordance with this invention;

FIG. 2 is a top view of the bow section of a boat to show the orientation of a springline;

FIG. 3 is a perspective view of a roller chock constructed in accordance with this invention;

FIG. 4 is a top view of the roller chock shown in FIG. 3; and

FIG. 5 is a sectional view taken along lines 5—5 in FIG. 4.

DESCRIPTION OF AN ILLUSTRATIVE EMBODIMENT

Now referring to FIG. 1, a boat 10 includes, as examples of my roller chock, a roller chock 11A mounted to starboard and a corresponding port roller chock 11B. These two chocks serve as bow chocks that are mirror images of each other. The subsequent discussion relates only to the roller chock 11A. In many applications only one bow chock will be used.

A bitt 12 mounted to the deck 13 is located aft the bow 14 and the bow chocks 11A and 11B. When the boat 10 normally rides at anchor, it is driven aft of a mooring or anchor by any wind. Thus, a line 15 from the mooring or anchor passes through the bow chock 11A and aft to the bitt 12. However, under various wind, current and tide conditions, it is possible for the boat 10 to ride forward so the line 15 is reoriented along the dashed line 15A shown in FIG. 1. In this position the line 15 tends to chafe if led through a bow chock of the prior art because it bends sharply around the narrow edge of the aft upstanding arm.

FIG. 2 shows a conventional docking arrangement in which a line 15 leads from the bitt 12 forward through the bow chock 11A and then aft to a bitt 16 mounted on a dock 17 to form a spring line. Again if prior bow chocks of a conventional nature are used, the line bends sharply around the narrow edge of aft curved arm and is subject to chafing and premature wear.

FIGS. 3 through 5 depict the various elements that constitute one embodiment of my roller chock that is used as a starboard bow chock. These elements are positioned on an elongated base 20 that lies along a longitudinal axis 21. The axis 21 is positioned essentially in line with the edge of the deck 13. A transverse axis 22 defines the center of the elongated base 20.

The roller chock shown in FIGS. 3 through 5 contains a curved arm portion 23 that is integrally formed with the base 20 and it is similar to the forward curved arm portion of a conventional bow chock. The radius of the curved arm portion 23 is formed about an axis 24 that is skewed with respect to the axis 21 so an inner surface 25 of the curved arm portion 23 tends to align with the line 15 in its normal orientation. Therefore, the surface 25 provides a smooth, flat surface against which the rode rides. With a substantial bearing area across the surface 25, motion of the rode 15 against the surface 25 does not introduce any significant wear. This results because no bending occurs around any sharp portions of the curved arm 23. In other embodiments of my roller chock, the axis 24 would be reoriented. For example, is a chock adapted for stern mounting, the axis 24 might be nearly parallel to the transverse axis 22.

A roller assembly 26 is positioned aft of the center line 22. As shown more specifically in FIGS. 4 and 5, the roller assembly 26 includes an upstanding shaft 27 that is positioned in an aperture formed in the base 20. A plug weld 30 anchors supports the shaft 27. A right cylinder roller 31 rides on the shaft 27 and is free to rotate about the shaft 27. Thus, if the line 15 assumes an orientation as shown by the line 15A in FIG. 1, any motion of the line rotates the roller 31. This essentially eliminates any sliding friction, the cause of line chafe.

A pie-shaped plate 32 mounts to the top of the shaft 27 by means of a machine screw 33 or other fastening device. The plate 32 extends beyond the inner circumferential area of the roller 27 thereby to close the space between the roller 31 and the curved arm 23. The enlarged portion also extends toward the center line of the boat. The plate 32 and horizontally extending portion of the curved arm 23 coact and tend to capture the rode between the surface 25 and the cylinder 31. This allows a crew member to position a line in my roller chock easily and yet tends to eliminate an inadvertent removal of the line.

As shown in FIG. 5, a sheet 34 of Teflon, or other similar material is disposed between the right cylinder 31 and the shaft 27 to act as a bearing. Such a bearing requires no other lubrication and at the same time reduces friction between the shaft 27 and the roller 31. In addition this material is not affected by corrosion and provides a substantial barrier between the two metallic elements.

The plate 32 can be located in a number of ways. In FIGS. 3 through 5 a locating pin 35 extends through the plate 32 and into a predetermined hole in the shaft 27. This properly positions the pie-shaped plate 32.

Although this roller chock could be constructed from any number of materials, I have found that a manganese bronze material to be extremely satisfactory. This material is easily machineable and resists corrosion in a salt water environment. I have found that a roller chock used as a bow chock and constructed in accordance with this description meets the objects of this invention. It essentially eliminates chafing on a line over an extended time. In extended testing I have found that this chock has a very long life expectancy, even in a salt water marine environment. It is dependable because it is simply constructed and requires essentially no maintenance. Moreover, it is relatively inexpensive to manufacture.

It will be apparent from the foregoing description that various modications could be made to the specifically disclosed embodiment of my roller chock with the attainment of some or all of the specific advantages. For example, a modified chock could use different configurations of the curved arm 23 and plate 32. Alternate roller arrangements might also be provided. Therefore, it is the object of the appended claims to cover all such variations and modifications as some within the true spirit and scope of this invention.

What I claim as new and desire to secure by Letter Patent of the United States is:

1. A roller chock for use with a line on a boat comprising:

A. an elongated base portion;

B. an arm having a curved generally L-shaped vertical cross-section extending upwardly from said base portion and having a generally vertical portion having a generally linear line-contacting surface skewed with respect to said base portion to align said line-contacting surface with the normal orientation of the line through said chock when the line is in contact with said line-contacting surface, and a horizontal portion having a free end extending rearwardly from the top of the vertical portion generally parallel to the baseplate;

C. a stationary vertical shaft having a lower end mounted to the base portion spaced rearwardly from said arm and a free upper end;

D. A roller mounted for bidirectional rotation about said shaft, said roller having a smooth cylindrical line-contacting surface;

E. a plate supported solely by the free end of said shaft above said roller parallel to said base, said plate extending from said shaft laterally of said roller inwardly of the boat and forwardly of said roller toward, but spaced apart from, said free end of said curved arm, and F. means for inhibiting rotation of said plate around said shaft, whereby said horizontal portion of said curved arm and said plate tend to capture the line passing through said chock, said vertical portion and said roller serving to limit lateral movement of the line.

* * * * *